US006449973B2

(12) United States Patent
Dodge et al.

(10) Patent No.: US 6,449,973 B2
(45) Date of Patent: Sep. 17, 2002

(54) CHILLED WATER MARINE AIR CONDITIONING

(75) Inventors: David A. Dodge; Frank A. Marciano, Jr., both of Boca Raton; Mason C. Heydt, Gulf Stream; James C. Harper, Lake Worth, all of FL (US)

(73) Assignee: Taylor Made Environmental Systems, Inc., Gloversville, NY (US)

( * ) Notice: Subject to any disclaimer, the term of this patent is extended or adjusted under 35 U.S.C. 154(b) by 0 days.

(21) Appl. No.: 09/764,305

(22) Filed: Jan. 19, 2001

(Under 37 CFR 1.47)

Related U.S. Application Data

(62) Division of application No. 09/409,870, filed on Oct. 1, 1999.

(60) Provisional application No. 60/106,067, filed on Oct. 29, 1998.

(51) Int. Cl.[7] ..... B63B 25/26

(52) U.S. Cl. ..... 62/240; 62/434

(58) Field of Search ..... 62/240, 434

(56) References Cited

U.S. PATENT DOCUMENTS

| | | | | | |
|---|---|---|---|---|---|
| 3,102,397 | A | | 9/1963 | Trucchi | |
| 3,111,013 | A | | 11/1963 | Ammons | |
| 3,822,566 | A | | 7/1974 | Lowi, Jr. | |
| 4,967,569 | A | | 11/1990 | Machen et al. | |
| 4,977,750 | A | | 12/1990 | Metcalfe | |
| 4,992,669 | A | * | 2/1991 | Parmley | 290/1 R |
| 5,070,704 | A | * | 12/1991 | Conry | 62/175 |
| 5,140,824 | A | * | 8/1992 | Hunt | 62/59 |
| 5,237,832 | A | | 8/1993 | Alston | |
| 5,329,784 | A | * | 7/1994 | Kennedy et al. | 62/262 |
| 5,598,715 | A | * | 2/1997 | Edmisten | 62/176.6 |
| 5,619,864 | A | * | 4/1997 | Reedy | 62/259.1 |
| 5,749,235 | A | | 5/1998 | Ueda | |
| 5,848,536 | A | * | 12/1998 | Dodge et al. | 62/240 |
| 5,984,198 | A | * | 11/1999 | Bennett et al. | 62/238.6 |
| 6,038,877 | A | * | 3/2000 | Peiffer et al. | 62/244 |

* cited by examiner

*Primary Examiner*—William E. Tapolcai
*Assistant Examiner*—Mohammad M. Ali
(74) *Attorney, Agent, or Firm*—Nixon & Vanderhye P.C.

(57) ABSTRACT

In a marine vessel (such as a yacht or other boat) in the range of 45–75 feet a chilled water air conditioning system is provided having a significant advantage over split central systems. Utilizing two-four water chilling modular units the chilled water capacity only needs to accommodate about 75–90% of the calculated BTU heat load for the vessel, while the air handlers are rated at about 100% of the calculated BTU heat load. Each modular unit has no refrigerant connection exterior of the casing containing all of its components, including a condenser coil, evaporator coil, compressor, reversing valve, and expansion tubing, all operatively connected to each other by refrigerant lines within the casing. Chilled water is circulated into and out of the evaporator coil by an exterior pump and expansion tank operatively connected to each of the modular units, the chilled water passing through a coil unit of an air handler. An exterior seawater pump pumps substantially ambient seawater into the condenser coil and is subsequently discharged to the exterior of the marine vessel, through its hull.

7 Claims, 4 Drawing Sheets

CHILLED WATER MARINE AIR CONDITIONING

CROSS-REFERENCE TO RELATED APPLICATION

This application is a divisional of application Ser. No. 09/409,870 filed Oct. 1, 1999, which is based upon provisional application Ser. No. 60/106,067 filed Oct. 29, 1998.

BACKGROUND AND SUMMARY OF THE INVENTION

The invention relates to a system and method to provide air conditioning in marine environments. While chilled water systems have been used in large commercial buildings and as the standard on very large yachts (over 80 feet), up until now central systems have been the only cost effective solution for cooling of yachts/marine vessels in the range of 45–75 feet, since the cost of chilled water systems has been prohibitive in this size boat. According to the invention it is possible to use modular units to provide chilled water for marine air conditioning, each unit having a cooling capacity of between 16,000–24,000 BTU's so that one unit may be used, or two through four units may be connected together, to effectively (both from the functional standpoint and cost effectively) cool boats in the range of 45–75 feet. The invention is particularly useful for vessels (such as 45 foot boats) which require a 36,000 BTU or greater capacity, with multiple condensing units and air handlers. The chilled water air conditioning system according to the present invention has reduced BTU requirements for the condensing units, no refrigerant line sets, enhanced balanced temperature control throughout the vessel, system energy management, and compressor redundancy to eliminate down time, as well as ease of serviceability.

As with all types of air conditioning systems, BTU load calculations must first be done on any vessel to be air-conditioned to ensure that the equipment selected can provide adequate heating or cooling for all applicable areas. With split central equipment there must be a one for one match of evaporator air handlers to condensing units. In other words, if a vessel requires 62,000 BTU's of air conditioning one must specify 62,000 BTU's of evaporator air handlers and 62,000 BTU's of central condensing. Normally one will have one condensing unit for each evaporator, in some cases one can have smaller evaporators matched to one condensing unit (i.e. one 24,000 BTU condenser can run 2×12,000 BTU evaporators).

Chilled water equipment, as according to the invention, has a significant advantage over split central systems in that only the air handlers must equal the calculated BTU heat load for the vessel, whereas the chilled water power plant only needs to accommodate 75–90% of the calculated BTU heat load. In the above example, 62,000 BTU of air handlers only requires 46,500–55,800 BTU's of chiller capacity. The size of the vessel, number of air handlers, and equipment selected determines the percentage of capacity required. Experience indicates that under nominal conditions a chiller plant operates at 50% or less of its capacity because of its automatic energy management feature.

With split central systems one may have only one thermostat control per central condensing unit to control both the condensing unit and the evaporator. Thus, if one has multiple evaporators on one condensing unit, a slave fan speed only control can be used on the slave evaporators, which may not coincide with the end user's preferences. The fan on the second evaporator must always run otherwise, icing can occur resulting in liquid return to the compressor potentially damaging the condensing unit.

With a chilled water system all air handler controls are totally independent from the chiller controls. The chiller has its own energy management system which automatically stages compressors on and off to control water temperature. Each air handler may have individual controls or up to four air handlers can be driven from a single control typically in a large common area. That is, temperature control is totally flexible throughout the vessel.

Installation of split central air conditioning systems requires that an EPA certified technician handle the refrigerant line sets. This is a government regulation imposed to ensure that the R-22 refrigerant used in the system does not escape into the atmosphere. This is a problem for most boat builders as it limits the number of people qualified to install split central equipment in manufacturing. Many boats builders have chosen to contract this work out and as a result can be a logistics problem in manufacturing. Done correctly, the process of attaching refrigerant line sets, evacuating the system, charging the system, finding and repairing leaks in flair fittings and finally balancing the system to ensure the proper refrigerant charge exists for optimum performance is very time consuming and costly for any production boat builder. In reality, due to customer delivery pressures much of this process is rushed, resulting in poor performance of the system in the field often creating warranty and long term reliability problems. Also, because boats, unlike fixed building structures, flex while underway, mechanical refrigerant line set fittings are constantly under stress often resulting in intermittent refrigerant leaks.

Since a chilled water system has a self-contained factory sealed refrigerant system, there are no refrigerant line sets to be installed in the vessel. Therefore, there is no need for an EPA certified technician to perform any installation or system balancing upon start-up. The self-contained chiller condensing unit is plumbed to the air handlers via insulated water lines, which is something boat builders are most familiar with. Installing chilled waterlines is as simple as linking a pump, and expansion tank with fill valve, to a closed plumbing loop. Pipe and insulation sizing can be read off of a simple chart and installed by anyone with basic plumbing skills, simplifying the manufacturing process. When the installation is complete, the installer fills the system with fresh water and uses built in air bleeders to purge all from the lines. Then one merely turns on the chiller and sets the air handler thermostats.

Split central systems operate completely independent of one another. This concept has worked well in many applications and gives the end user desired individual climate control, however, there are some drawbacks.

1. Because the thermostats are independent they can easily oppose each other because of air spill over from one area to another. Since each thermostat controls a condensing unit this causes short cycling of compressors leading to premature failure.
2. If a condensing unit fails, there is no redundancy, and the section of the boat which relies on that unit for cooling will not have cooling until the unit is repaired.
3. There is no energy management between the condensing units. They turn on and off independently, and therefore they can be on or off at any given point in time regardless of the total overall heat load on the boat. Only the independent thermostats control the individual compressors.

Although chilled water system air handlers operate independently, they are all tied to the same parallel chilled water loop which is fed back to the chilled water condensing units allowing the compressors to cycle on and off based upon the heat load on the total water loop. Because each air handler is tied into one chilled water loop the total heat load is integrated into one system which is the basis for energy management of the condensing units. The fact that air handlers are independent allows for desired independent thermostatic control without creating compressor short cycling conditions because the chilled water condensers react to the total balanced load of the chilled water loop.

Each air handler removes heat from the cabin space and transfers the heat into the cold chilled water loop. As air handlers turn on and off, the average temperature returning in the closed loop to the chiller condensers rises and falls. The chiller condensing system senses the temperature of the water and turns compressors on and off based upon the overall total heat load of the boat. The change in temperature of the water is very gradual since the volume of water contains stored energy, which acts as an energy buffer. This gradual change eliminates short cycling of the compressors therefore increasing the useful life of the system and eliminates those initial cold blasts of air associated with typical direct expansion start-ups.

The chilled water condensers only need enough capacity for 75–90% of the total heat load calculations of the boat. Since heat load calculations are typically based on high ambient worst case conditions, the only time full capacity is needed is for a warm start up. Under normal operation, 50% of the total cooling capacity is usually more than enough to remove heat from all areas of the boat. This is why 75–90% downsizing of chilled water condensers as compared to total worst case heat load requirements is practical in all applications.

Chilled water systems normally comprise two or more modular condensing units (hence the 36,000 BTU minimum discussed above) which have independent sealed compressor systems creating complete operational redundancy. This means that if a chilled water condensing unit malfunctions for any reason to the operating condensing unit(s) will continue to remove heat from the chilled water loop, which provides cooling to the entire vessel. Since 50% capacity is normally all that is required of a system operating in nominal conditions, the end user has time to facilitate repairs without being inconvenienced.

Mechanical breakdowns in a split central system require an EPA certified technician to troubleshoot and repair the system. In case of compressor's failure, the entire system needs to be evacuated and removed for replacement or repair. During this process the end user may be seriously inconvenienced as discussed above. Upon replacement, the entire sealed system mush be evacuated, recharged and balanced for proper operation. This can be a costly and time-consuming process, not to mention the possibility of a poor flare fitting or a loose flare.

Since a chilled water system has redundant components, a component or compressors failure rarely results in inconvenience to the end user. Although some repairs will require an EPA certified technician, the end user can choose to remove the self-contained sealed unit and replace it in a matter of hours or send it to an authorized service center for repairs. Removal of a modular chilled water condensing unit simply requires disconnecting and capping off the water lines and disconnecting the electrical supply. Installation of the new or repaired unit requires connecting water lines, bleeding out the air and reconnecting the electricity.

The location of the modular condensing unit according to the invention should be dry and accessible for service. The condensing unit should be secured to a level horizontal surface with brackets. The brackets hold the weight of the equipment as well as handle nay torsional movement. Each condensing unit must be independently supported, not stacked directly on top of each other.

Also according to the invention reinforced marine grade hose is to be used for the seawater circuit. The hose is to be routed upwards from the thru-hull intake to the condensing unit to prevent air locks in the centrifugal seawater pump. Circulation connections between the condensing unit and chilled water lines are to be made with properly sized fittings and reinforced marine grade hose. All hose connections are to be double clamped. Ball valves should be installed at chilled water inlet/outlet at each unit and each air handler for overall serviceability of system. All hose and fittings should be properly insulated upon completion of leak tests to prevent condensation and energy or capacity loss. The condensing unit chassis for each modular unit has an integral condensation drain pain for removal of any water that may form. A hose should be secured to this drain pan spud and routed downward to a proper sump or overboard discharge outlet.

The air conditioner air handler is never installed in bilge or engine room areas. It is important to insure that the selected location is sealed from direct access to bilge and/or engine room vapors. Condensate drain lines should not be terminated within four feet of any outlet of engine or generator exhaust systems, nor in a compartment housing an engine or generator, nor in a bilge (vapors can travel up the drain line), unless the drain is connected properly to a sealed condensate or shower sump pump. Failure to comply may allow bilge or engine room vapors to mix with the air conditioners return air and contaminate living areas.

All circuit breakers and wire gauge must be sized according to marine design standards. Only stranded tinned copper wire should be used. All wiring should be routed through strain-relief connectors provided in the electrical boxes.

All equipment should be properly grounded using grounding lugs provided on each unit's chassis. Electrical boxes are pre-wired for power and control circuits. Mechanical control panels can be remote mounted in a convenient location, using four mounting screws. Field wiring is required between remote switch and unit electrical box.

All chilled water condensing units according to the invention use closed-refrigerant circuits, precharged with R-22 refrigerant, hermetically sealed, and factory tested and certified. No additional refrigerant is required during the installation or at initial start-up-and operation of the system. In keeping with regulations set forth by the EPA, only certified technicians should perform service on, or make adjustments to, any refrigerant circuit.

The system according to the invention functions as follows: During the off-peak requirement times a single compressor would handle the air conditioning load on its own, and only requires a second compressor to kick in if the first is not able to adequately chill the water based upon the ambient temperature. This is important especially in relation to shore power and/or generation on-board. With current competitive systems, due to the fact that the compressors cycle together, they require a much larger power draw and one might have to run a generator overnight to meet the electrical demand. Not only is this a noise pollution problem, but also the carbon monoxide produced from the exhaust to the generator is a potential life hazard. With the system of the invention, since a single compressor will handle the load in the off-peak times (i.e. late evening, overnight, early morning), there is no need for additional power other than the typical shore power hook-up (30 amp). One benefit of this is that boater uses the power he/she paid for with the docking, instead of the fuel for the generator. It should also be noted that in order to achieve long life of the system components, the compressors may be programmed to cycle/run in "rotation" so that the same compressor is not the one running each time a single compressor handles the load.

The installation of the modular units of the invention, each of which is basically a "shoebox" which looks very simple and nondescript, requires substantially only hook-up of power and four hoses (two saltwater (intake and discharge) and two for fresh water feed and return lines to the air handlers). In addition, the control panel/unit is preferably completely solid state for ease of use, and operation.

The modular units according to the invention may be provided in a plurality of sizes. For example there may be three sizes, 16,000 BTU/H, 20,000 BTU/H, and 24,000 BTU/H (cooling capacity). The 24,000 BTU/H units may use scroll compressors, while the other units use rotary compressors. The condenser coil may be constructed of spiral fluted cupronickel to provide maximum heat transfer and high corrosion resistance. The 16,000 BTU/H units typically have a depth of between 17–19 inches (e.g. about 18 inches), a width of about 10–13 inches (e.g. about 11 ½ inches) and a height of between about 10–13 inches (e.g. about 11.25 inches). The 20,000 BTU/H units have the same depth and width but with a height of between about 12–15 inches (e.g. about 13.5 inches). The 24,000 BTU/H units may have the same depth but a width of between about 12–14 inches (e.g. about 13 inches) and a height of between about 14–17 inches (e.g. about 15.75 inches).

According to one aspect of the present invention a marine vessel (such as a yacht or other boat (with a chilled water air conditioning system is provided comprising: A marine vessel in the range of 45–75 feet, and including a plurality of different areas to be air conditioned and having a predetermined high ambient worst case conditions cooling capacity. An air handler, including a coil unit and a blower, associated with each of at least some of the different areas. Between two-four water-chilling modular units for cooling water and circulating the cooled water to the air handler coil units, the modular units each having a condenser coil and the units collectively having a condenser cooling capacity between about 75–90% of the predetermined cooling capacity. And a chilled water pump and expansion tank unit operatively connected to the water-chilling modular units.

The system according to the invention also includes the following aspects: The water chilling modular units each comprise a compressor, an evaporator coil, a reversing valve, and expansion tubing in addition to the condenser coil. The condenser coil, compressor, reversing valve, evaporator coil, and expansion tubing are disposed within substantially the same casing, and are mounted on a drain pan. Four hose connections are provided for the casing, two of the hose connections are operatively connected to the condenser coil and connected by a hose to a seawater pump and an overboard discharge of the marine vessel, and two of the connections are operatively connected to the chilled water pump and an air handler coil unit. Solid state electronics for operating the modular units are provided so that which of the plurality of units is running at any point in time when less than full capacity of the collective units is necessary is rotated. Each of the units preferably has a capacity of about 16,000 BTU's per hour, about 20,000 BTU's per hour, or about 24,000 BTU's per hour. Each of the units preferably has a depth of between about 17–19 inches, a width between about 10–14 inches, and a height of between about 10–17 inches. The solid state electronics preferably comprises freeze-stat protection and an associated sensor, a solid state control with a digital readout providing temperature and diagnostic information and as inputs a high refrigerant pressure switch, a chilled water flow switch, and a return water sensor.

According to another aspect of the present invention a water-chilling modular unit for air conditioning a marine vessel is provided. The unit comprises: The casing having a power line extending therefrom and a plurality of water transporting hose connections in the exterior thereof, the casing being devoid of any refrigerant lines extending in or out thereof. A compressor, condenser coil, evaporator coil, reversing valve, and expansion tubing provided within the casing, including refrigerant lines extending therebetween. Two of the water transporting connections operatively connected to the condenser coil, and two of the connections operatively connected to the evaporator coil, the evaporator coil circulating chilled water therein and chilling the water circulating therein.

The water-chilling unit according to the invention also includes: A casing is mounted on a drain pan to receive condensate from components within the casing. Each of the units has a capacity of about 16,000 BTU's per hour, about 20,000 BTU's per hour, or about 24,000 BTU's per hour. Each of the units has a depth of between about 17–19 inches, a width between about 10–14 inches, and a height of between about 10–17 inches. A high refrigerant pressure switch is preferably operatively connected to a refrigerant line between the compressor and the reversing valve. Pumps for circulating water through the water transporting connections are mounted exteriorly of the casing, and there is no water circulating pump mounted interior of the casing. A solid state control mounted exteriorly of the casing includes freeze-state protection and a supply water temperature monitor, and a digital readout providing temperature and diagnostic information.

According to yet another aspect of the present invention there is provided a method of air conditioning a marine vessel (such as a yacht or other boat) in the range of 45–75 feed and including a plurality of different areas to be air conditioned and having a predetermined high ambient worst conditions cooling capacity, using a chilled water air conditioning system and an air handler, including a coil unit and a blower, associated with each of at least some of the different areas to be air conditioned. The method comprises: (a) Connecting between two-four water chilling modular units for cooling water and circulating the cooled water to the air handler coil units, each modular unit including a condenser coil and an evaporator coil within the marine vessel, the modular units having collectively a condenser cooling capacity between about 75–90% of the predetermined cooling capacity; and (b) circulating substantially ambient water from exteriorly of the marine vessel to the condenser coil and ultimately discharging the circulated water from the condensing coil to the exterior of the vessel.

In the method preferably (a) is practiced utilizing water-chilling modular units each having a cooling capacity of between about 16,000–24,000 BTU's, and the method further comprises operating less than all of the water-chilling modular units during low cooling load conditions while operating at least one of the water-chilling modular units, and rotating which of the water-chilling modular units are operated or not operated during low cooling load conditions.

It is the primary object of the present invention to effect air conditioning of a marine vessel, particularly in the 45–75 foot size, utilizing a chilled-water system, which is advantageous compared to conventional split central systems. This and other objects of the invention will become clear from an inspection of the detailed description of the invention and from the appended claims.

DETAILED DESCRIPTION OF THE DRAWINGS

Figure 2:
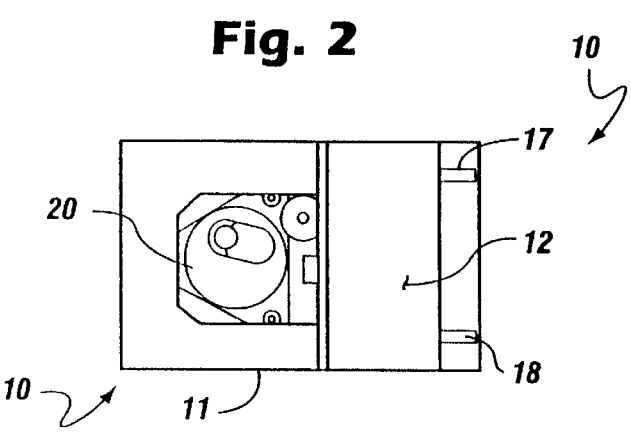
FIG. 2 is a top view of the unit of FIG. 1.
Figure 4:
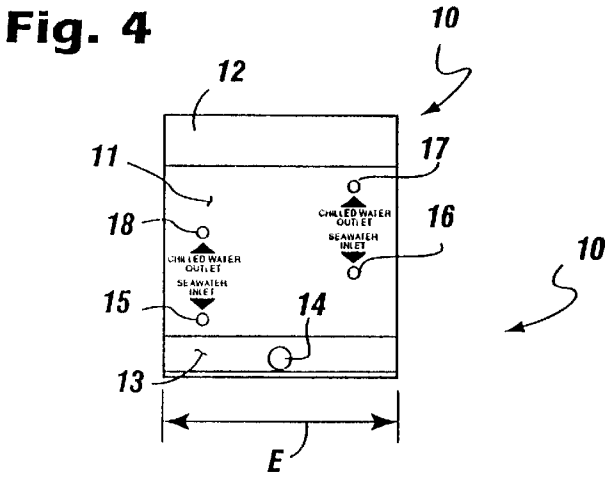
FIG. 4 is a front end view of the unit of FIG. 1.
Figure 3:
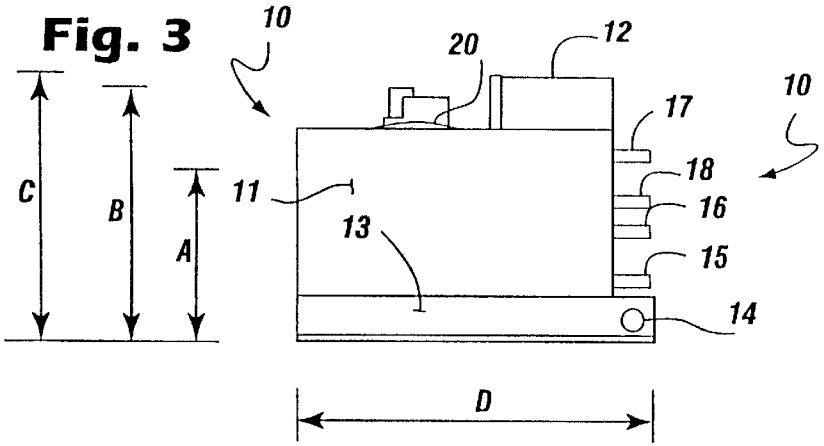
FIG. 3 is a side view of the unit of FIG. 1.

A water-chilling modular unit according to the invention is shown generally by reference numeral 10 in the drawings, and includes an outer sheet metal casing or housing 11 typically having the dimensions as discussed above, with an electrical box 12 on top. The box 12 is connected up to a suitable source of electrical power. FIGS. 3 and 4 illustrate exemplary dimensions of the unit 10. The housing 11 is mounted on a drain pan 13 which has a plurality of knock-out plugs/alternative outlet connections 14 for condensate draining. Unit 10 includes a seawater inlet/hose connection 15, a seawater outlet/hose connection 16, a chilled water inlet/hose connection 17, and a chilled water outlet/hose connection 18, all preferably provided on the same face of housing 11 as illustrated in FIGS. 1 through 4; no refrigerant lines are exterior of the casing 11.

FIGS. 3 and 4 illustrate various dimensions A–E that may be utilized for an exemplary modular unit 10 according to the invention. While the dimensions will vary depending upon the size of the modular unit 10 (e.g. depending upon whether it has a 16,000 BTU/H, 20,000 BTU/H, 24,000 BTU/H, or some other size, cooling capacity), the dimension A may be about eleven inches, the dimension B about thirteen inches, the dimension C about thirteen and a half inches, the dimension D about eighteen inches, and the dimension E about eleven and a half inches, for a 20,000 BTU/H unit. A 16,000 BTU/H unit would have the same depth D and width E but a height C of between about ten—thirteen inches (e.g. about 11.25 inches), whereas a 24,000 BTU/H unit would have the same depth D but a width E between about twelve–fourteen inches (e.g. about thirteen inches) and a height C between about fourteen–seventeen inches (e.g. about 15.75 inches).

Figure 1:
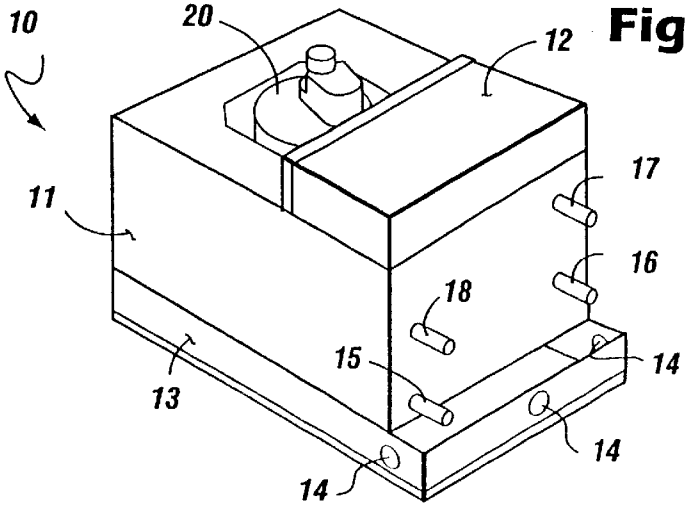
FIG. 1 is a top schematic perspective view of an exemplary modular chilling unit according to the present invention.
Figure 6:
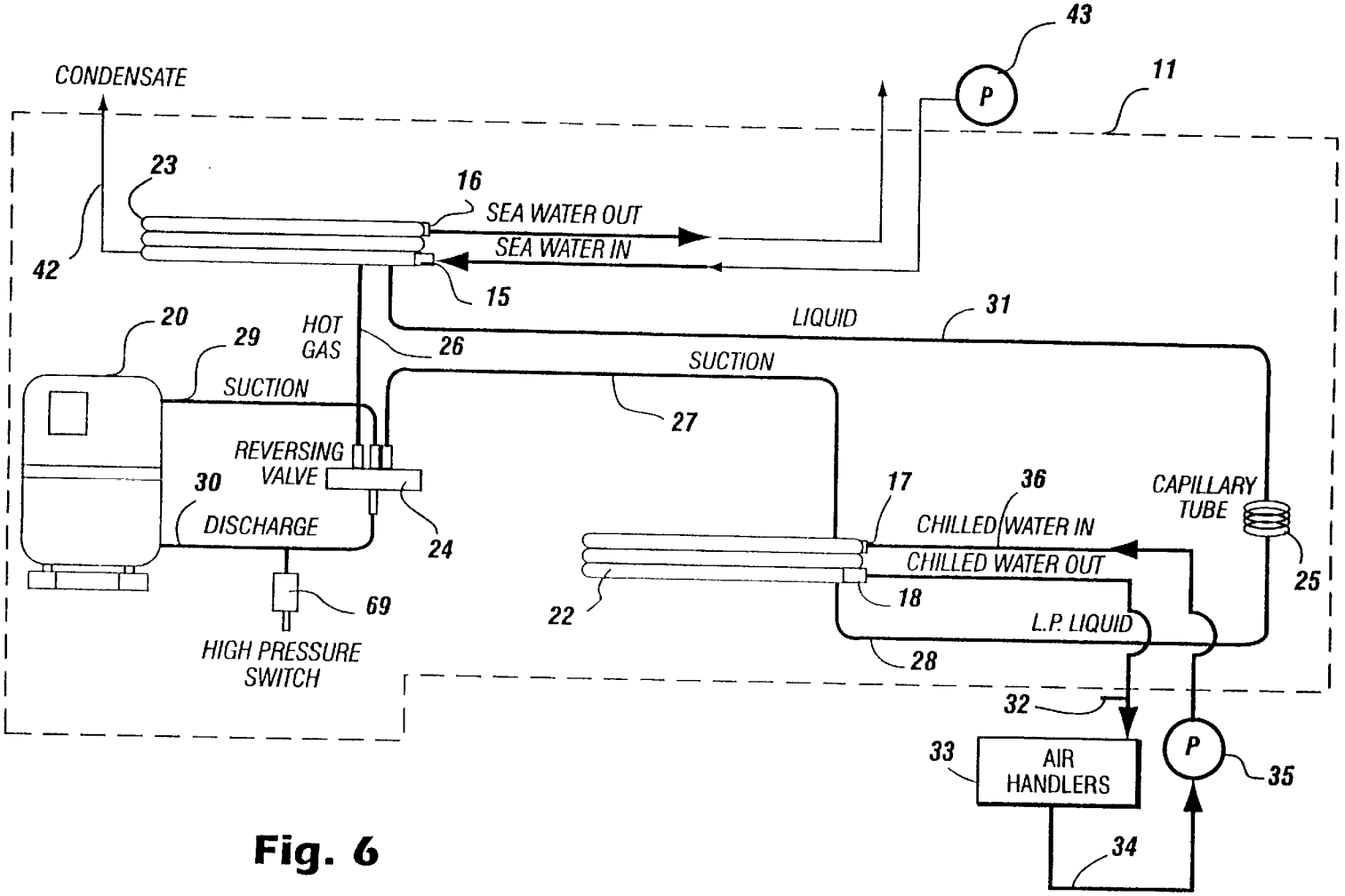
FIG. 6 is a schematic illustration of the interior components of the unit of FIG. 1.

The internal components of the unit 10, inside the housing 11, are illustrated schematically in FIG. 6. The operative components preferably comprise a high efficient compressor 20, such as a Tecumseh rotary compressor or a Copeland scroll compressor, connected to a conventional tube-in-tube spiral fluted evaporator coil 22, and a cupronickel condenser coil 23. With reference to FIGS. 1 and 6, the evaporator coil 22 and the condenser coil 23 are arranged in substantially parallel planes, and the compressor 20 is disposed within a space created by the coils 22, 23. Connections are done by conventional conduits as illustrated in FIG. 6 for transporting refrigerant (preferably R-22) in a conventional manner. A reversing valve 24 is also provided, as well as expansion tubing—shown only schematically at 25 in FIG. 6. FIG. 6 shows the refrigerant lines 26–31 connected to the operative components with flow in reverse cycle (that is the cooling mode). The flows are reversed for heating, as is conventional. Fresh water flows in the lines (17, 18) and through the evaporator 22, the coldest water being discharged from outlet 18 through line 32 to the air handlers 33, with a return line 34 through a pump and expansion tank unit 35, in turn connected via line 36 to the chilled water inlet 17. The lines and units 20–31 all have refrigerant—such as R-22—flowing therethrough and are hermetically sealed within the housing 11 so that no connection of refrigerant to any external system is necessary. All of the lines and units exterior of the housing 11 simply handle water.

Figure 5:
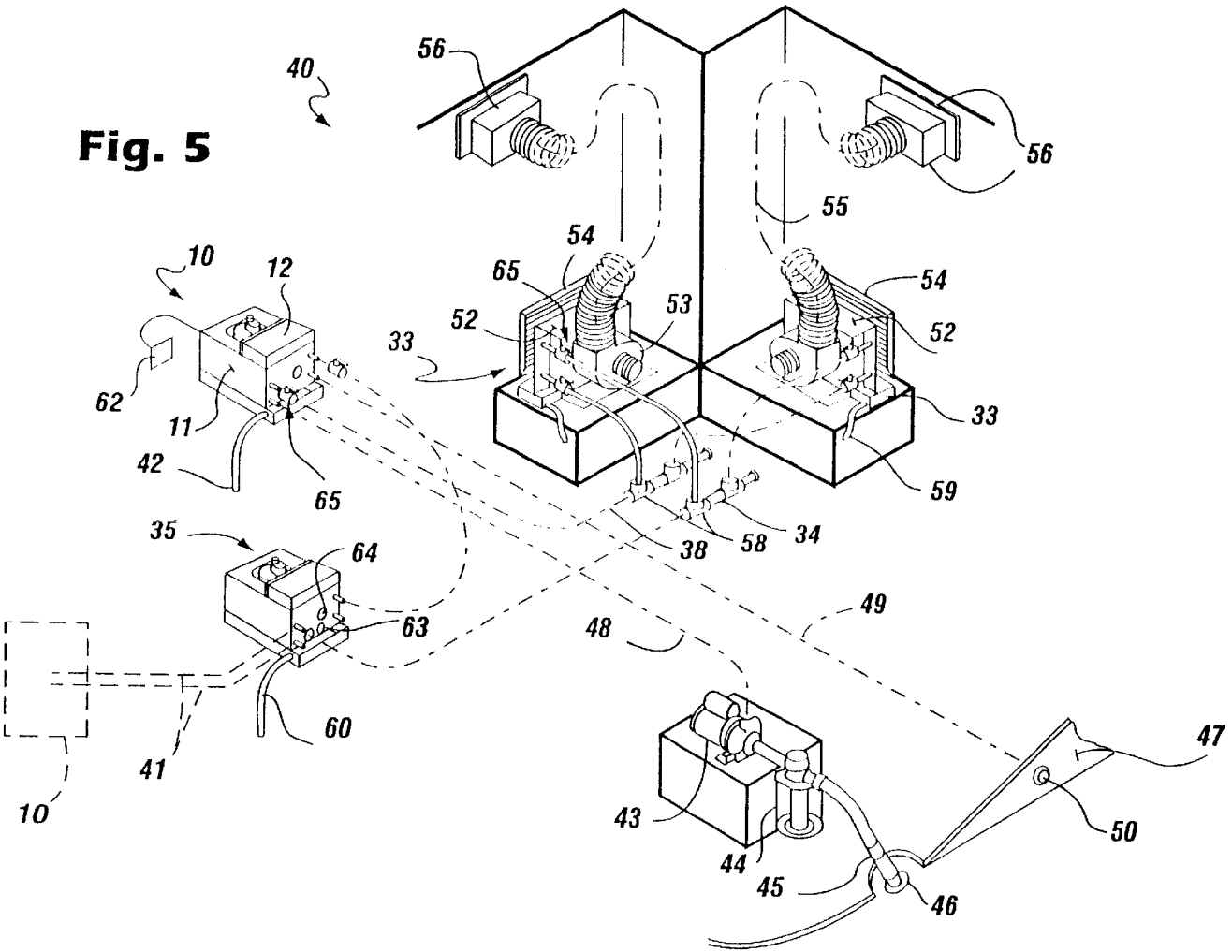
FIG. 5 is a schematic perspective view showing the utilization of one of the units of FIG. 1 in association with two air handler assemblies, it being understood that typically two-four units like that in FIG. 1 are utilized in a 45–75 foot boat, and more than two air handlers may be utilized.

FIG. 5 illustrates a system, shown generally by reference numeral 40, according to the invention with only one unit 10 being shown in solid line for simplicity, however it is understood—as illustrated by the dotted lines 41 in FIG. 5—that other units 10 (typically one-three additional units 10) are connected to the system 40 to typically provide between two and four units 10.

The condensate drain from the condenser 23 in each unit 10 is directly into the pan 13, in open communication therewith, and is eventually connected by a hose 42 to an ultimate conventional drain (not shown).

FIG. 5 shows the conventional seawater pump 43 connected through a seawater strainer 44 and a conventional shut-off valve 45 to a thru-hull fitting 46 (e.g. a clam shell scoop) penetrating the hull 47 of a 45–75 foot boat. The seawater pump 43 is connected via the conduit 48 to the inlet 15, while the outlet 16 is connected via the conduit 49 to a conventional overboard discharge 50 in the hull 47. The conventional air handler assemblies 33 for cooling the cabin space of the marine vessel each preferably include a coil unit 52 through which the chilled water in line 32 flows, and a blower 53 which blows air past the cooling coil 52 into the cabin space to be air conditioned on the boat having the hull 47. Each of the units 33 may have a return air grill with filter 54, and the cooled air passes through a flexible duct 55 to a conventional transition box and supply air grill 56. While two handlers 33 are illustrated in FIG. 5, for cooling two different cabin spaces, more than two air handlers 33 may be provided, each connected via a conventional water-tight connection 58 to the pipes 32, 34. Typically each air handler 33 also has a condensate drain 59.

The unit 35, which includes a chilled water pump and an expansion tank, typically has substantially the same dimensions as a unit 10, with multiple inlets and outlets for connection to two–four units 10, as schematically illustrated for two such units 10 in FIG. 5. A condensate drain 60 is also typically associated with unit 35, and it has a conventional fill valve 63, and a conventional water pressure gauge 64, as seen schematically in FIG. 5. Conventional manually (or automatically) operated ball valves 65 are also typically used in water lines as needed; for example in the positions illustrated in FIG. 5.

Figure 7:
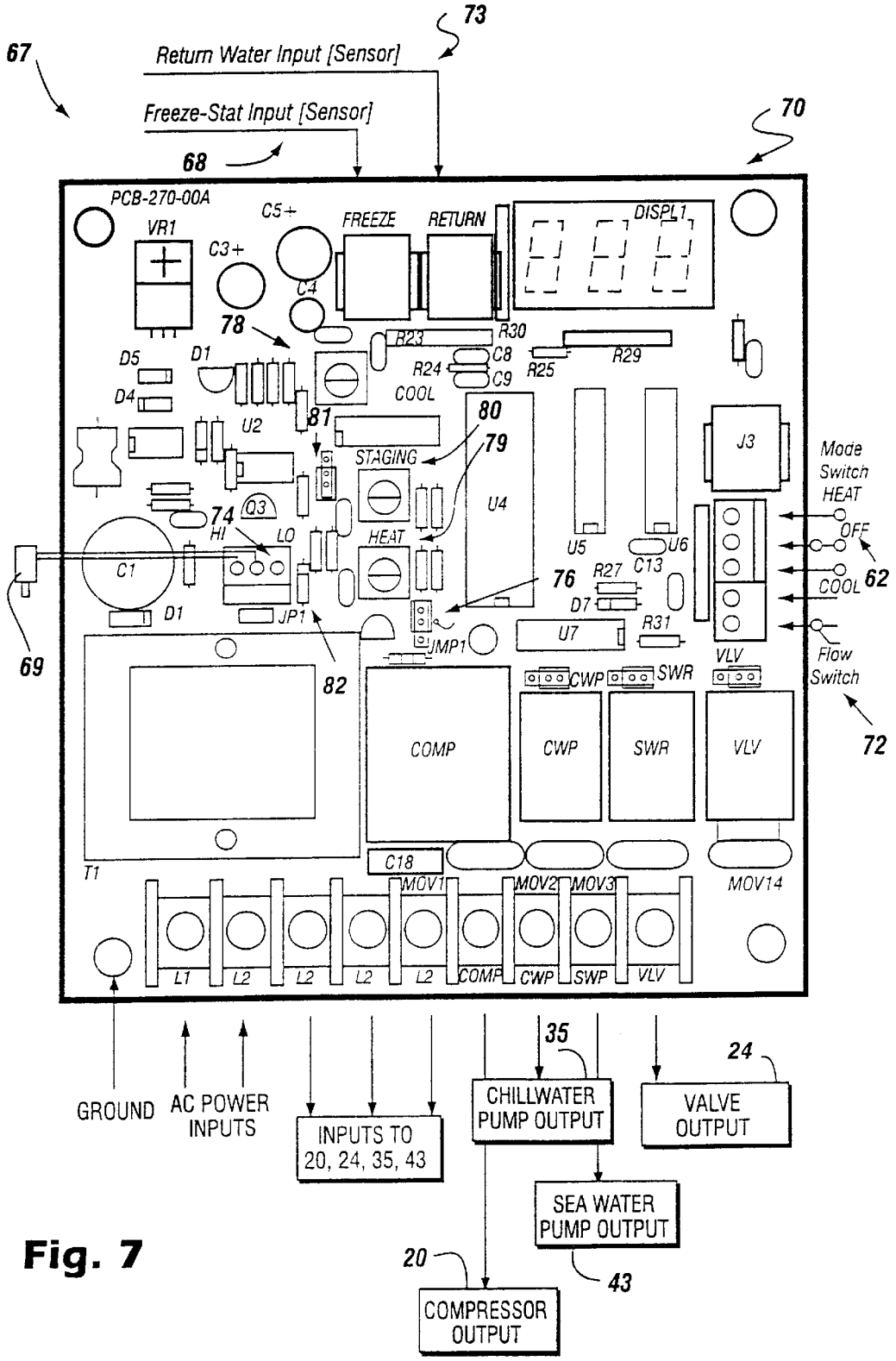
FIG. 7 is an electrical schematic relating to the operation of the unit of FIG. 1 in the system of FIG. 5.

FIG. 7 schematically illustrates an electrical schematic showing the interconnection between the various components of the system 40 to provide effective control thereof. Typically a master control switch—illustrated schematically at 62 in FIGS. 5 and 7—is provided to control the system 40, each electrical box 12 typically including only solid state components.

The solid state control, shown generally at 67 in FIG. 7, for the chiller system 10 monitors the return water temperature and controls the operation of the compressor 20 based on the set point. The heat and cool mode are selected by the control switch 62. The supply water temperature is monitored by sensor 68 to ensure the temperature does not exceed the limits of the equipment. The high pressure switch 69 is monitored to ensure a high refrigerant pressure fault does not harm the equipment. Built in time delays allow for staging of multiple units. The heat and cool set points are adjusted on the circuit board. A digital readout 70 provides temperature and diagnostic information.

For the solid state circuitry 67, typically 220 volt operation is provided, although 115 volt operation may be available by changing the upper strapping on the transformer connected to the unit 67. The inputs to the unit 67 include the high refrigerant pressure switch 69 (which may also have inherent low freon pressure sensing, which is connected to the additional contact illustrated at 74 in FIG. 7, when utilized), a chilled water flow switch 72 located at an appropriate location within the chilled flow, return water sensor 73, the sensor 68 (which includes independent freezestat protection), and high water limit protection switch/gauge 64, connected where appropriate to the unit 67.

The switch 62 switches between the cooling mode, heating mode, and off mode, and may comprise any conventional switch for the purpose. The freeze stat protection associated with the sensor 68 preferably is set to open at 38° F. and close at 50° F. (and is ignored in the heating mode). The high temperature limit typically opens at 125° F. and closes at 120° F., and is ignored in the cool mode.

The control unit 67 preferably is equipped with four conventional "Bimini Jumpers" (one shown schematically at 76 in FIG. 7) which allow any or all of the relay outputs to be forced on for troubleshooting or emergency operation.

The components of the solid state control 67 are preferably provided so as to provide the following operation:

When the main circuit breaker (not shown, connected to the "AC Power Inputs") is turned on, the display 70 will display the revision code for five seconds. The display 70 will go bland for one second and remain bland if the mode switch 62 is "off". If the system is heating or cooling, the display 70 will indicate the return water temperature (as sensed by the sensor 73). The unit 67 will operate according to the present temperature and staging delays.

The unit 67 will operate the unit 10 to cool when the mode switch 62 is "cool" position, and the return water temperature is 2° F. more than the cool set point. The freeze stat (68) and flow switch (72) circuits must be closed. The high limit is ignored in the cooling mode.

The control unit 67 will control the unit 10 to heat when the mode switch 62 is in the "heating" mode, and the return water temperature is 2° F. lower than the heat set point. The flow switch 72 circuit must be closed. The freeze stat (68) is ignored in this mode.

No cycle will be started if the return water sensor 73 is open, or if the freeze stat 68 and flow switch 72 circuits are open. The chilled water pump 35 operates substantially continuously when the unit is in the heat or cool mode. The seawater pump 43 turns on one minute before the compressor 20 starts and turns off one minute after the compressor 20 cycle is completed. The valve 24 is toggled and relieve head pressure if the previous cycle ended within 75 seconds of a new cycle, and the valve 24 is also toggled when the unit is powered up from the circuit breaker.

The return water temperature is set with the system "on" by adjusting the cool trim variable resistor, the actuator 78 thereof being seen in FIG. 7. The selected temperature will appear on the display 70 and remain visible while the cool point is adjusted by turning the actuator 78. The setting will remain on the display 70 for five seconds after the adjustment is completed. The cooling set point range is preferably between about 40–55° F. The same procedure is followed for setting the heating set point, using the actuator shown schematically at 79 in FIG. 7 for adjusting the heating variable resistor. The heating range set point is preferably between about 100–200° F.

The staging delay is also set, when with unit 67 (the switch 62) is either in the "heat" or "cool" mode. The staging trim point is adjusted by adjusting the actuator shown schematically at 80 in FIG. 7 for the staging pot, until the desired compressor staging delay appears on the display 70. Staging delay will remain in the display 70 for five seconds after the adjustment is completed. The staging adjustment range is preferably between about 10–110 seconds.

If desired the unit 67 can display in degrees Celsius instead of Fahrenheit by moving the F/C jumper 81 from the lower to upper position when the power is off. Also fault displays may be provided in the display 70 such as "high freon pressure", "low freon pressure", "chilled water flow switch", "freeze stat", "return sensor", or "high water limit" when a fault is indicated by one of the units 64, 68, 69, 72, or 73. For the fault handling protocol, at the end of the staging delay the unit 67 will restart if all the faults have been cleared. If a low freon pressure switch is installed (e.g. using contact 74), the low freon jumper 82 must be cut. The low freon pressure fault preferably has a ten minute delay. When a fault occurs the staging delay is initiated, and the appropriate display is flashed in the unit 70. If three faults occur before the cycle is completed lockout will occur. Operation may be restored by correcting the fault and resetting the unit 67 with the mode switch 62 or by turning the AC power off and on (as by using a circuit breaker connected to the "AC power unit" in FIG. 7). The mode switch 62 is then reset by turning if off and then back to the heat or cool mode, respectively.

It will thus be seen that according to the invention an effective, and cost effective, series of modular cooling units are provided associated with a marine vessel air conditioning system which uses chilled water—and has the inherent advantages associated therewith—to cool boats typically in the 45–75 foot range. It should be understood that many modifications may be provided according to the invention, including the substitution of conventional equivalents for each of the components described above. Also, for each of the ranges given above all smaller ranges within a broad range are also specifically provided herein. Therefore the invention is to be accorded the broadest interpretation possible, limited only by the prior art, to encompass all equivalent structures and methods.

What is claimed is:

1. A chilled water air conditioning module comprising:

a casing having a power line extending therefrom and a plurality of water transporting hose connections in the exterior thereof, said casing being devoid of any refrigerant lines extending in or out thereof;

a compressor, condenser coil, evaporator coil, reversing valve, and expansion tubing provided within said casing, including refrigerant line extending therebetween, wherein the evaporator coil and the condenser coil are arranged in substantially parallel planes defining a space, and wherein the compressor is disposed within said space; and two of said water transporting connections operatively connected to said condenser coil, and two of said connections operatively connected to said evaporator coil, said evaporator coil circulating chilled water therein and chilling the water circulating therein.

2. A water-chilling modular unit is recited in claim 1 wherein said casing is mounted on a drain pan to receive condensate from components within said casing.

3. A water-chilling modular unit is recited in claim 1 wherein each of said units has a capacity of about 16,000 BTU's per hour, about 20,000 BTU's per hour, or about 24,000 BTU's per hour.

4. A water-chilling modular unit is recited in claim 1 wherein each of said units has a depth of between about 17–19 inches, a width between about 10–14 inches, and a height of between about 10–17 inches.

5. A water-chilling modular unit is recited in claim 1 further comprising a high refrigerant pressure switch within said casing operatively connected to a refrigerant line between said compressor and said reversing valve.

6. A water-chilling modular unit is recited in claim 1 wherein pumps for circulating water through said water transporting connections are mounted exteriorly of said casing, and no water circulating pump is mounted interior of said casing.

7. A water-chilling modular unit as recited in claim 1 further comprising a solid state control mounted exteriorly of said casing, said solid state control including freeze-stat protection and a supply water temperature monitor, and a digital readout providing temperature and diagnostic information.

* * * * *